United States Patent [19]

Kozel et al.

[11] Patent Number: 4,719,321

[45] Date of Patent: Jan. 12, 1988

[54] WIRE LOCATOR AND STRAIN RELIEF DEVICE

[75] Inventors: Charles A. Kozel, McHenry; John T. Scheitz, Barrington, both of Ill.

[73] Assignee: Methode Electronics, Inc., Chicago, Ill.

[21] Appl. No.: 889,753

[22] Filed: Jul. 28, 1986

[51] Int. Cl.[4] ..... H01R 13/514

[52] U.S. Cl. ..... 174/135; 174/156; 439/731

[58] Field of Search ..... 174/135, 155, 156, 157; 339/17 F, 59 M, 107, 196 M, 208, 210 R, 210 M; 439/731, 732, 752

[56] References Cited

U.S. PATENT DOCUMENTS

| | | | |
|---|---|---|---|
| 508,687 | 11/1893 | Duggan | 174/157 |
| 1,240,844 | 9/1917 | Gregur | 174/155 |
| 4,139,727 | 2/1979 | Kuballa | 174/135 X |
| 4,225,205 | 9/1980 | Sinclair et al. | 339/107 X |
| 4,611,868 | 9/1986 | Matsui et al. | 339/210 M X |

FOREIGN PATENT DOCUMENTS

| | | | |
|---|---|---|---|
| 57-46632 | 10/1982 | Japan | 339/210 M |
| 321874 | 11/1929 | United Kingdom | 174/157 |

*Primary Examiner*—Laramie E. Askin

*Attorney, Agent, or Firm*—Charles F. Pigott, Jr.

[57] ABSTRACT

A wire locator and strain relief device comprises a pair of plastic strip members. Locking means hold the strip members together, the strip members together defining a plurality of parallel, coplanar channels, each for receiving separate, insulated wires, to firmly hold such wires in a single-plane,precisely positioned configuration. Thus, ends of the wires may be precisely located relative to each other for installation into an electronic circuit member such as a circuit board.

11 Claims, 5 Drawing Figures

FIG. 1
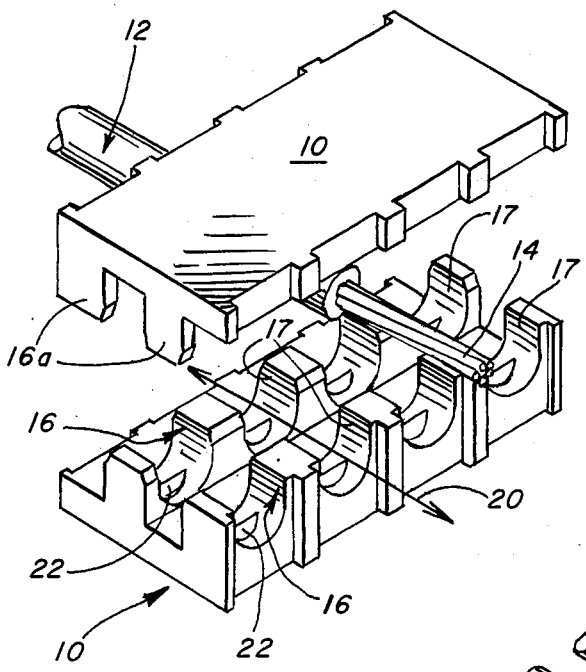
FIG. 2
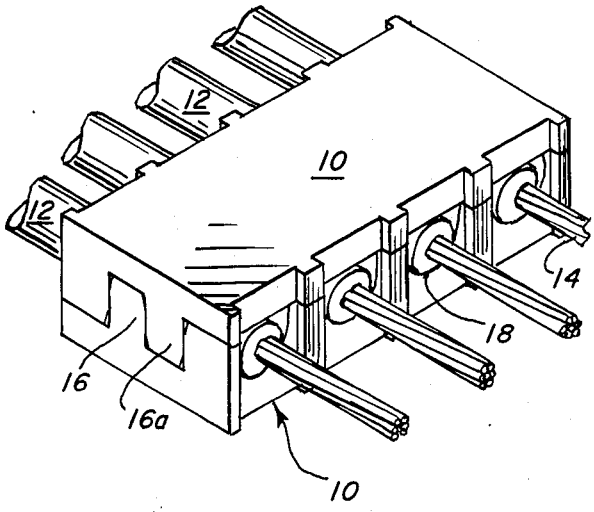
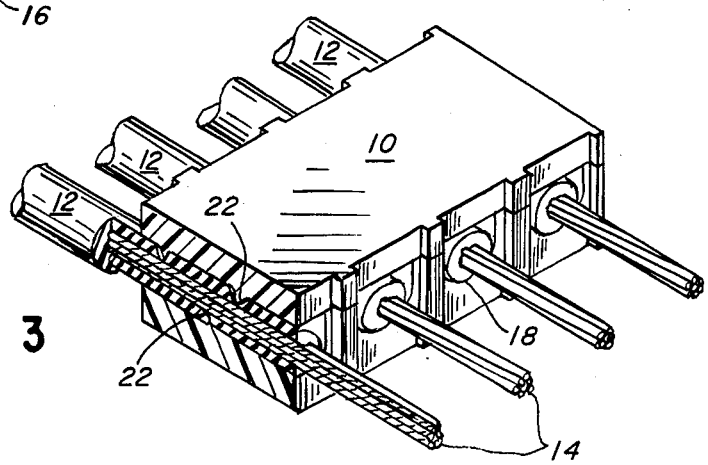
FIG. 3
FIG. 4
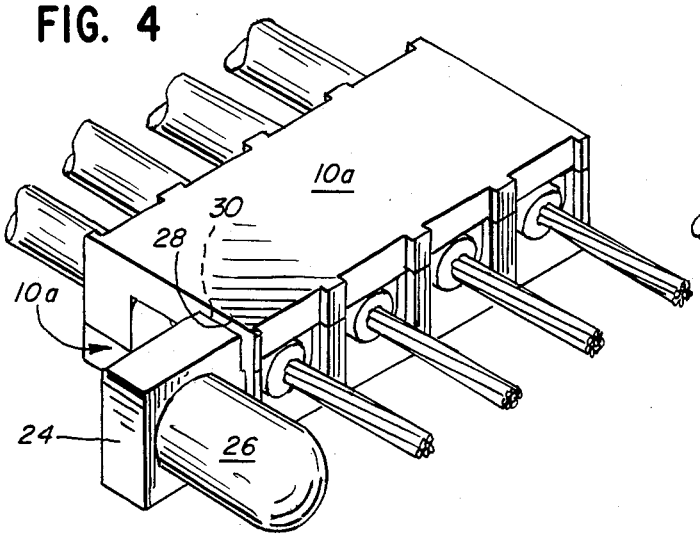
FIG. 5
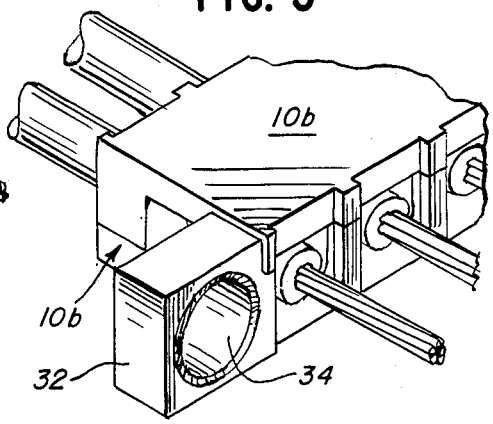

WIRE LOCATOR AND STRAIN RELIEF DEVICE

BACKGROUND OF THE INVENTION

In electronic design, many individual wires are soldered with precise positioning on a printed circuit board. Not only must the wires be precisely positioned with very close tolerance, but they must be protected with some manner of strain relief so that the solder connection will not be broken in the event of pulling on the wire.

Many techniques for this have been used, but they tend to be relatively expensive and cumbersome. For example, electrical contacts may be placed on the wires and then locked into place on a circuit board or other electronic circuit member. However, such is both cumbersome and expensive.

In accordance with this invention, small individual wires may be positioned in predetermined relation without the use of relatively expensive connectors. Thus the positioned wires are available for further processing by connection to an electronic circuit member, with each wire occupying a precise position. This provides a significant efficiency in an electronics manufacturing process in that an entire group of individual wires, ten, twenty or more wires, may be simultaneously attached to an electronic member while being precisely positioned and protected by strain relief means, all without the need of contacts.

Accordingly , significant manufacturing advantages are provided to electronic assembly, with savings in time and money due to the wire positioning and protective function of this invention, without the need of extra contacts. Additionally, one extra connection is eliminated: the connection between the wire and the contact, with clear, significant advantages provided by such an improvement.

BRIEF DESCRIPTION OF THE INVENTION

In accordance with this invention, a wire locator and strain relief device is provided which comprises a pair of plastic strip members. The strip members define locking means which hold the strip members together. The strip members, when connected together, define a plurality of parallel, coplanar channels, each for receiving separate, insulated wires, to firmly hold the wires in a single-plane, precisely positioned configuration. As the result of this, ends of the wires may be precisely located relative to each other for installation into an electronic circuit member such as a wiring harness or circuit board.

Preferably, the plastic strip members may be essentially identical in shape so that a single design of strip members may be provided in bulk, with pairs being selected and brought together about the wires.

Each strip member may define a pair of spaced, channelforming members, which cooperate to form each of said coplanar channels. The channel-forming members are positioned is asymmetric manner in the direction of the axis of the channels to be defined. The channel-forming members are proportioned to fit together with the channel-forming members of the other mating strip member to define said channels.

Preferably, each channel-forming member may also define a transverse ridge means to frictionally engage an insulated wire occupying said channel.

The connected pairs of plastic strips may be held together by locking connection, ultrasonic welding, or any other desired technique, to lock in position a plurality of insulated wires for the advantages described above. The two plastic strips preferably may fit together with a slight interference prior to being locked together by the locking means, so that proper wire positioning can be provided by adjustment prior to final locking, and also to allow the system to be staged prior to final locking together.

BRIEF DESCRIPTION OF THE DRAWINGS

In the drawings, FIG. 1 is an exploded view of a pair of the plastic strip members of this invention in the process of engaging an insulated wire.

FIG. 2 is a perspective view of the locked plastic strip members carrying wires in the channels defined thereby.

FIG. 3 is a perspective view similar to FIG. 2, but with a broken away portion.

FIG. 4 is a perspective view of a modified embodiment, in which each plastic strip member carries a mounting peg.

FIG. 5 is a fragmentary perpsective view similar to FIG. 4, but with a mounting hole member shown instead of the mounting peg.

DESCRIPTION OF SPECIFIC EMBODIMENTS

Referring to the drawings and especially FIG. 1, a pair of identical plastic strip members 10 are shown, positioned for assembly to form the wire locator and strain relief device of this invention. A single insulated wire 12, having a stripped, projecting wire section 14, is shown in the process of being placed between strip members 10 for installation and retention therebetween.

Each strip member 12 is made of a molded piece of plastic, and may be quite small, having a largest dimension on the order of one inch, for example, although the particular size of the strip members of this invention is not critical.

Each strip member 10 defines a pair of spaced, channel-forming members 16 or **16*a* to cooperate with the channel-forming members of the other, identical strip member 10, to cooperatively define the plurality of parallel, co-planar channels 18 which are formed by the interlocked pair of strip members 10, with insulated wires 12 retained therein (see FIGS. 2 and 3). It can be noted that channel-forming members 16, 16*a* are positioned in asymmetric manner in the direction of the axis 20 of each channel to be defined. Because of this, the two identical plastic strip members 10 can fit together, with the respective channel-forming members 16 interlocking with channel-forming members 16*a* to form each complete channel 18 for receiving insulated wires 12**.

Also, each channel-forming member 16, **16*a*, defines retention means for the insulated wire. In this specific instance, the retention means is a transversely positioned ridge 22, positioned in each of the semi-circular recesses 17 which are defined in each of the spaced channel-forming members 16, 16*a*. Accordingly, as shown particularly in FIG. 3, projecting ridges 22 dig into the insulation of wires 12** as shown to provide frictional tension for strain relief and positioning purposes.

As shown, the respective insulated wires 12 are placed into the lower plastic strip member 10. Then the upper plastic strip member 10 is placed into position as shown in FIG. 2, to capture and retain the wires. Preferably, plastic strip members 10 may be proportioned to hold together by interference fit in the FIG. 2 configuration, so that the wire positions may be adjusted as necessary. Following this, the pairs of plastic strips are locked together. In this specific embodiment, the locking means may be an adhesive bond created by a chemical adhesive, or by a heat seal such as ultrasonic or radio frequency sealing. Thus, the individual wires are locked together between the sealed, interlocking strips 10, to provide a fixed positioning of the wires relative to each other as well as good strain relief. It then becomes an easy matter to direct the stripped wire ends 14 to their appropriate positions for attachment to any type of any electronic circuit member, for example a wiring harness or a circuit board.

Wire ends 14 may be exposed by stripping either before or after the securance of wires 12 between plastic strips 10

Turning to FIG. 4, a modified version of the device of FIGS. 1 thru 3 is disclosed. Plastic strips 10*a* are shown in interlocking relation with each other, and may be of a design and function identical to the previous embodiment except as otherwise disclosed. Specifically, each strip 10*a* may carry a projection 24 which, in turn, carries a mounting ped 26. Mounting peg 26 can be proportioned to fit into an aperture of the electronic circuit member to which the structure is to be attached. Specifically, projection 24 is attached to the lower strip member 10*a* as shown in FIG. 4. Wall 28 of the upper strip 10*a* is proportioned to clear exposed inner edge 30 of projection 24. Since strip members 10*a* are reversed with respect to each other in their locked position, each carries a projection 24 and mounting peg 26 on an opposite side of the connected assembly.

Referring to FIG. 5, the connected strip members 10*b* may be of identical design to strip members 10*a*, with the exception that in each strip member projection 32 replaces projection 24. Each projection 32 has an outer periphery that is similar in design to projection 24, but each projection 32 carries a mounting hole 34 rather than a peg. Thus, the assembly of strips 10*b* can be mounted on an electronic circuit member which has a pair of appropriately sized and positioned pegs for penetration into the respective holes 34.

Thus, the wire locator and strain relief device of this invention may be used to capture a plurality of insulated wires and to position their ends in a predetermined, co-planar relationship for presenting the wire ends for easy and convenient installation into an electronic circuit member. Additionally, the device of this invention provides excellent strain relief for the wires at a cost which is significantly less than prior art configurations for a similar purpose, since the need for an entire set of terminals can be eliminated. The device of this invention may be free of metal components, except for the separate, insulated wires, which contributes to the significant cost savings that may be achieved.

The above has been offered for illustrative purposes only, and is not intended to limit the scope of the invention of this application, which is as defined in the claims below.

That which is claimed is:

1. A wire locator and strain relief device which comprises a pair of plastic strip members, locking means holding said strip members together, said strip members together defining a plurality of parallel, coplanar channels, each for receiving separate, insulated wires, to firmly hold said wires in a single-plane, precisely positioned configuration, in which each strip member includes a pair of spaced channel-forming members for each coplanar channel present, said channel-forming members being positioned in asymmetric manner in the direction of the axes of the channels, and the channel-forming members of one strip member fitting together in alternating relation with the channel-forming members of the mating strip member to form said channels, whereby ends of wires may be precisely located relative to each other, for installation into an electronic circuit member.

2. The device of claim 1 in which said plastic strip members are substantially identical in shape.

3. The device of claim 2 in which each channel-forming member also includes a transversely positioned ridge to frictionally engage an insulated wire when occupying the associated channel.

4. The device of claim 1 which includes means for mounting said device onto an electronic circuit member.

5. The device of claim 1 in which said plastic strip members are proportioned to hold together by interference fit prior to application of said locking means.

6. The device of claim 1 which is free of metal components.

7. In combination, a wire locator and strain relief device and a plurality of insulated wires, comprising: a pair of plastic strip members substantially identical in shape to each other, locking means holding said strip members together, said strip members together defining a plurality of parallel, coplanar channels, at least a plurality of said channels each holding and retaining separate, insulated wires, whereby said wires are held in a single-plane, precisely positioned configuration, with the ends of said wires being precisely located relative to each other for installation into an electronic circuit member, in which each strip member includes a pair of spaced, channel-forming members for each coplanar channel, said channel-forming members being positioned in asymmetric manner in the direction of the axes of the channels which they define, said channel-forming members of one strip member fitting together with the channel-forming members of the mating strip member and defining said channels.

8. The combination of claim 7 in which said plastic strip members are proportioned to hold together by interference fit prior to application of said locking means.

9. The combination of claim 8 in which each channel forming member also includes a transversely positioned ridge for each channel that it helps to define, said ridges frictionally engaging the insulated wires occupying said channels.

10. The combination of claim 9 which includes means for mounting said device onto an electronic circuit member.

11. The combination of claim 10 which is free of metal components except for said separate, insulated wires.

* * * * *